US006058882A

United States Patent [19]

Leutholt

[11] Patent Number: 6,058,882

[45] Date of Patent: May 9, 2000

[54] PETPOTTY-PICKUP

[76] Inventor: Robert Mark Leutholt, 15180 Fruitville Rd., Sarasota, Fla. 34240

[21] Appl. No.: 09/305,471

[22] Filed: May 6, 1999

[51] Int. Cl.[7] ..... A01K 23/00; A41D 19/01

[52] U.S. Cl. ..... 119/161; 2/158

[58] Field of Search ..... 119/161, 600, 119/652, 850; 2/158, 161.7

[56] References Cited

U.S. PATENT DOCUMENTS

| | | | |
|---|---|---|---|
| 3,786,780 | 1/1974 | Pezzino | 119/161 |
| 4,020,156 | 4/1977 | Murray | 119/161 |
| 5,178,426 | 1/1993 | David et al. | 119/161 |
| 5,406,649 | 4/1995 | Bolembach | 2/158 |
| 5,799,331 | 9/1998 | Stewart | 2/158 |
| 5,806,099 | 9/1998 | Grinberg | 2/158 |

*Primary Examiner*—Peter M. Poon
*Assistant Examiner*—Elizabeth Shaw
*Attorney, Agent, or Firm*—Robert M. Leutholt

[57] ABSTRACT

An apparatus for retrieval and disposal of domesticated house animal's waste. The apparatus is in the form of a mitten having a draw strap at the bottom The mitten is formed of pliable plastic and has a wrist opening large enough to permit removal of a clenched hand containing the waste and inversion of the mitten.

2 Claims, 1 Drawing Sheet

PETPOTTY-PICKUP

BACKGROUND OF THE INVENTION

I. Field of the Invention

An apparatus constructed of pliable plastic shaped and designed as an oversized mitten that may be scented or unscented for the collection and sanitary disposal of solid feces generated by domesticated house animals.

II. Description of the Prior Art

It is the contention of the inventor that there is no prior art for this particular apparatus in question. In lieu of this, with no existing prior art, comparisons or improvements for the above-mentioned apparatus are nonexistent.

SUMMARY OF THE PRESENT INVENTION

It is the object of the invention to provide a proper and sanitary manner in which to collect and dispose of the solid feces generated by domesticated house animals. This apparatus is used when the domesticated animal is being walked for bowel relief, whether it be in a neighborhood, park, etc., anywhere it is not legal to leave the feces at the point of defecation. It may also be used for the collection and disposal of feces in any area, for sanitary reasons or otherwise.

The apparatus consists of an oversized pliable plastic mitten having a draw strap at the wrist. The mitten has an exterior surface and an interior surface. The waste is gripped within the palm of the outer surface. The mitten is adapted to be inverted by holding the draw strap. The outer surface and waste are now inverted and contained in a holding area formed by the outer surface. The draw strap is drawn to close the holding area. The mitten is now ready for disposal.

DESCRIPTION OF THE DRAWING

The present invention will be fully understood by reference to the following detailed description, wherein like reference characters refer to like parts throughout the several views, and in which.

DETAILED DESCRIPTION OF THE INVENTION

Figure 1:
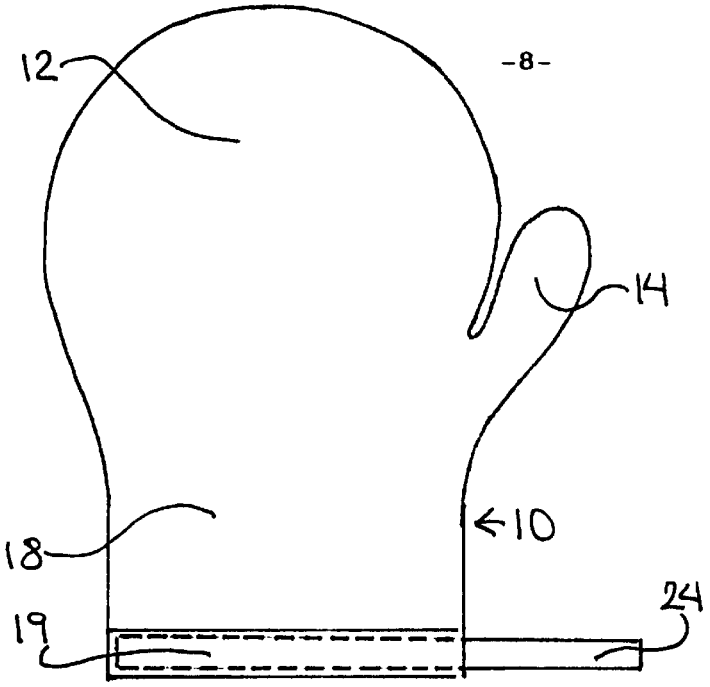
FIG. 1 is a front view of the over sized mitten-like apparatus of pliable plastic and as shown one inch continuous cinch or draw strap embodied within the band located at the bottom of the apparatus for closure of said apparatus.
Figure 3:
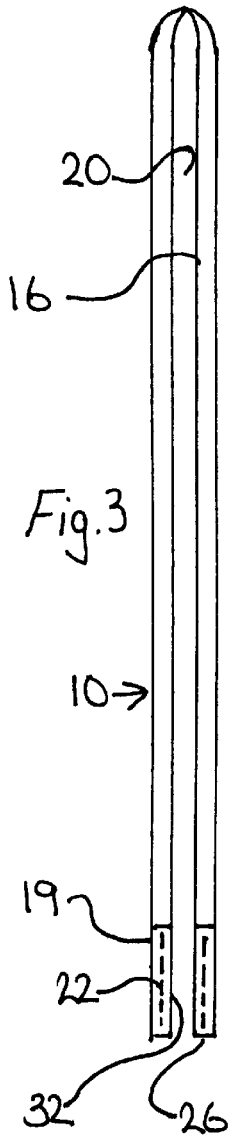
FIG. 3 is a sectional view of the over sized mitten-like apparatus depicting the continuous one inch cinch or draw strap that is embodied in the band located at the bottom of this mitten-like apparatus for closure of said same.
Figure 2:
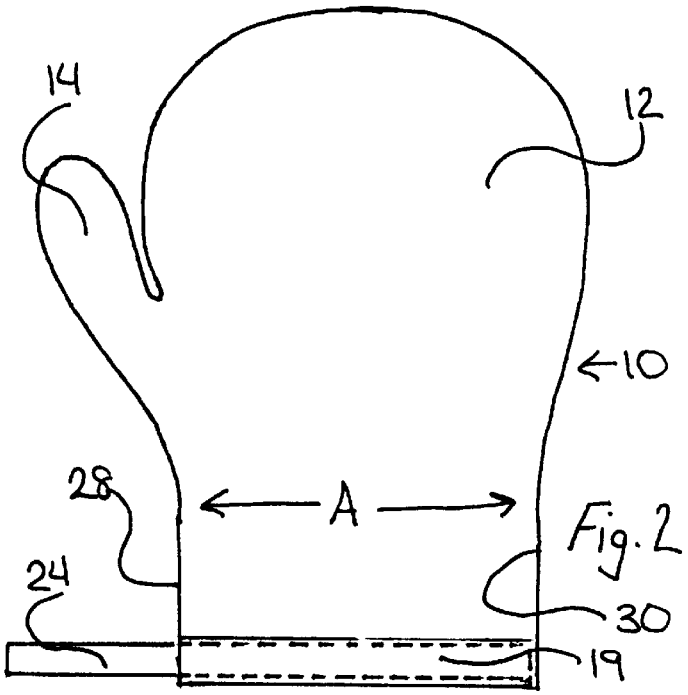
FIG. 2 is a back view of the over sized mitten-like apparatus of pliable plastic and as shown a one inch continuous cinch or draw strap embodied within the band located at the bottom of the apparatus for closure of said apparatus.
Figure 1:
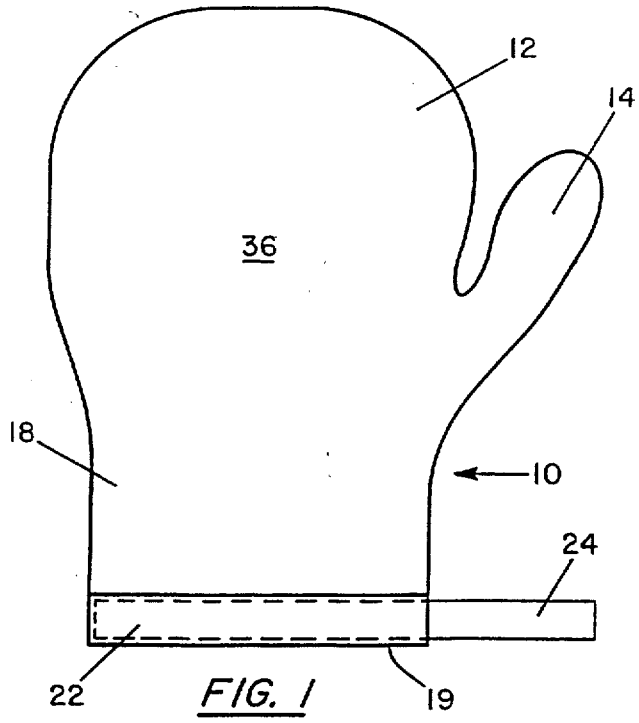
Figure 2:
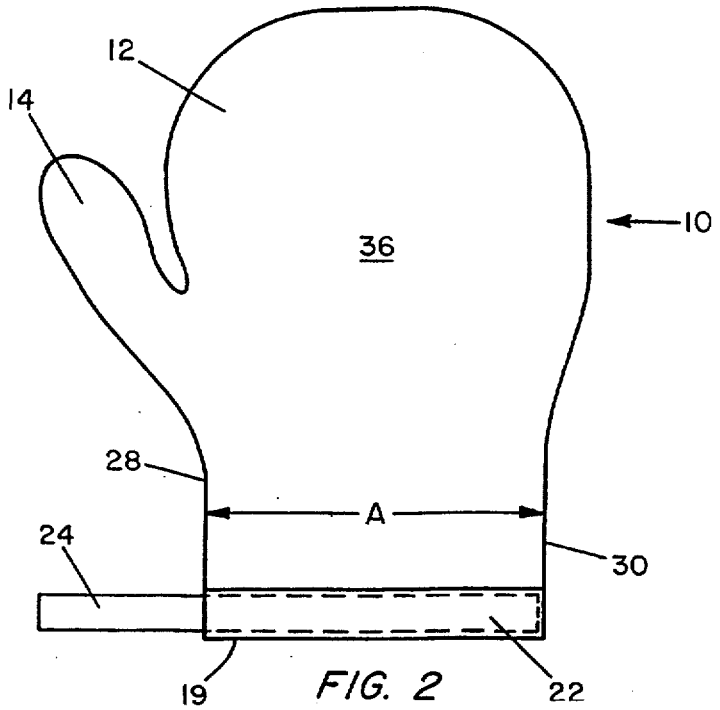
Figure 3:
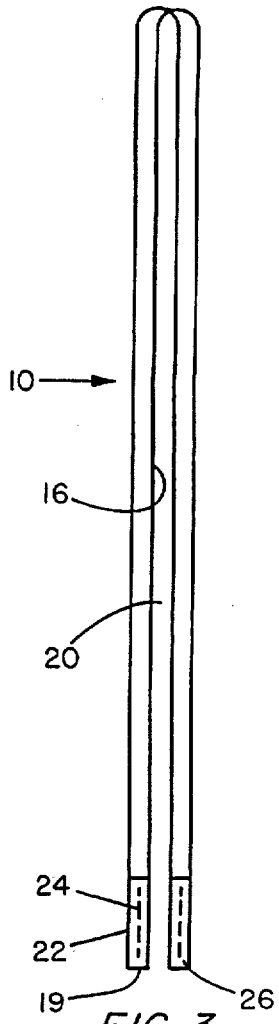

This collection apparatus 10 depicted in FIGS. 1, 2, and 3 is an elongated member 11 made of pliable scented or unscented plastic. When used in conjunction with the human hand (right or left) a proper sanitary collection and disposal of solid feces is accomplished. This apparatus 10 may be used in certain instances where the collection and disposal of solid feces is deemed necessary by law or for sanitary reasons. The hand is inserted in the over sized mitten-like apparatus 10 (right or left) where the four main fingers are placed in a large portion 12 of the mitten and the thumb is placed in a thumb portion 14. This enables the person to handle and pick up the feces effortlessly and without problem The apparatus 10 has an inner surface 16 and an outer surface 18 extending to an open end 19. The inner surface 16 forms a cavity 20 for accepting the hand. A band 22 forming a pocket for a draw strap 24 is positioned about the open end 19. The draw strap 24 extends outwardly through an opening 26 in the band 22. The thumb portion 14 extends outwardly from one side 28 of the apparatus. An opposite side 30 of the apparatus extends generally parallel to the one side 28 from the band 22 having a girth "A" where the thumb portion 14 begins to extend outwardly. The girth "A" between the sides 28 and 30 is generally the same as the open end 19 to facilitate removal of a clenched hand to invert the apparatus.

After the insertion of the hand, the person must collect the feces by gently enclosing the hand and palm portion 36 of the outer surface 18 around the feces with a closed fist motion. With this function accomplished, the person will then take the bottom 19 of the apparatus to proceed to invert and pull said same over the closed fist and palm portion 36 of the mitten. When the apparatus 10 is completely turned inside out the person then will remove the hand releasing the feces, which is now confined inside the outer surface 18 of the apparatus. Pulling the cinch or draw strap 21 tight will close the apparatus 10, thus securing the feces inside said same. When these functions have been performed correctly, the person has successfully collected the solid feces in a safe, non-contact, sanitary manner for proper disposal.

I claim:

1. A mitten for collection and disposal of solid feces, said mitten comprising:

a flexible elongated member having a pair of sides extending from an open end to an enclosed top portion, said elongated member having a tubular portion angling outwardly away from one of said sides and being adapted to receive a thumb of said user, said open end having a band extending around an opening and having an opening on said outer surface, a drawstring slidably positioned within said band and having a portion extending through said opening in a direction away from said opening, said elongated member having an inner surface defining a cavity for receiving a hand of a user and an outer surface, said mitten having a predetermined girth between said sides at a position adjacent said tubular portion which is generally equal to a girth of said open end to permit withdrawal of said hand when closed around the feces, whereby said inner surface is inverted when the hand of the user is closed on the feces and the inner surface of said mitten and withdrawn through said opening, said drawstring operable to close the opening of the mitten when the mitten is inverted.

2. The mitten of claim 1, wherein said flexible mitten further comprises a scented material.

* * * * *

UNITED STATES PATENT AND TRADEMARK OFFICE

CERTIFICATE OF CORRECTION

PATENT NO. : 6,058,882
DATED : May 9, 2000
INVENTOR(S) : Robert Mark Leutholt

It is certified that error appears in the above-identified patent and that said Letters Patent is hereby corrected as shown below:

The Title page should be deleted and substitute therefor the attached Title page.

Drawings:

Delete Drawing sheets 1-3, and substitute therefor the Drawing sheets, consisting of Figs. 1-3, as shown on the attached page.

Signed and Sealed this

Twenty-ninth Day of August, 2000

*Attest:*

*Attesting Officer*

Q. TODD DICKINSON

*Director of Patents and Trademarks*

United States Patent [19]

Leutholt

[11] Patent Number: 6,058,882

[45] Date of Patent: May 9, 2000

[54] PETPOTTY-PICKUP

[76] Inventor: Robert Mark Leutholt, 15180 Fruitville Rd., Sarasota, Fla. 34240

[21] Appl. No.: 09/305,471

[22] Filed: May 6, 1999

[51] Int. Cl.[7] ..... A01K 23/00; A41D 19/01

[52] U.S. Cl. ..... 119/161; 2/158

[58] Field of Search ..... 119/161, 600, 119/652, 850; 2/158, 161.7

[56] References Cited

U.S. PATENT DOCUMENTS

| | | | |
|---|---|---|---|
| 3,786,780 | 1/1974 | Pezzino | 119/161 |
| 4,020,156 | 4/1977 | Murray | 119/161 |
| 5,178,426 | 1/1993 | David et al. | 119/161 |
| 5,406,649 | 4/1995 | Bolembach | 2/158 |
| 5,799,331 | 9/1998 | Stewart | 2/158 |
| 5,806,099 | 9/1998 | Grinberg | 2/158 |

*Primary Examiner*—Peter M. Poon
*Assistant Examiner*—Elizabeth Shaw
*Attorney, Agent, or Firm*—Robert M. Leutholt

[57] ABSTRACT

An apparatus for retrieval and disposal of domesticated house animal's waste. The apparatus is in the form of a mitten having a draw strap at the bottom The mitten is formed of pliable plastic and has a wrist opening large enough to permit removal of a clenched hand containing the waste and inversion of the mitten.

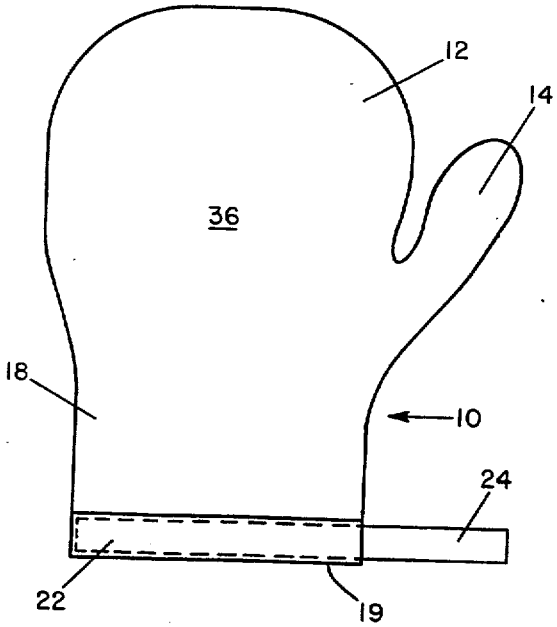

2 Claims, 1 Drawing Sheet